United States Patent [19]

Krüger et al.

[11] Patent Number: 4,463,583

[45] Date of Patent: Aug. 7, 1984

[54] APPARATUS FOR APPLYING FOAM

[75] Inventors: Max Krüger, Krefeld; Manfred Moser, Krefeld-Fischeln, both of Fed. Rep. of Germany

[73] Assignee: Eduard Küsters, Krefeld-Forstwald, Fed. Rep. of Germany

[21] Appl. No.: 374,059

[22] Filed: May 3, 1982

[30] Foreign Application Priority Data

Aug. 8, 1981 [DE] Fed. Rep. of Germany ..... 3131545

[51] Int. Cl.[3] ..... D06B 1/06

[52] U.S. Cl. ..... 68/205 R; 118/412; 239/186; 239/243; 137/561 A

[58] Field of Search ..... 118/407, 409, 412, 413; 239/185, 186, 225, 243, 461, 463, 553, 562; 68/205 R; 137/561 A; 222/482, 488; 366/264; 261/DIG. 26

[56] References Cited

U.S. PATENT DOCUMENTS

| | | | |
|---|---|---|---|
| 1,833,497 | 11/1931 | Prouty | 239/225 X |
| 2,661,291 | 12/1953 | Veneziano | 239/227 |
| 3,046,177 | 7/1962 | Hankins | 239/463 X |
| 3,092,329 | 6/1963 | Twaroch | 239/227 |

FOREIGN PATENT DOCUMENTS

| | | | |
|---|---|---|---|
| 1105851 | 5/1961 | Fed. Rep. of Germany | 366/264 |
| 1199391 | 7/1970 | United Kingdom | 239/227 |
| 1296725 | 11/1972 | United Kingdom | 68/205 R |

*Primary Examiner*—Philip R. Coe
*Assistant Examiner*—Frankie L. Stinson
*Attorney, Agent, or Firm*—Kenyon & Kenyon

[57] ABSTRACT

Apparatus for applying foam onto continuously advancing webs of material in which several nozzles are provided which are connected to a foam distributor which comprises a chamber with foam outlets as well as a distribution rotor which rotates in the chamber and is in communication with a foam feed line directing the foam from the inside toward the foam outlets.

15 Claims, 6 Drawing Figures

6
9
11
12
13
14
15
16
17
18
19
20
21
22
23
24
25
26
40
IV
VI

APPARATUS FOR APPLYING FOAM

BACKGROUND OF THE INVENTION

This invention relates to apparatus for applying foam to a continuously advancing web in general and more particularly to improved apparatus of this nature permitting uniform application through a plurality of spaced nozzles.

Foam applicators for applying foam to an advancing web of material such as a textile web, e.g. a carpet, utilizing a plurality of nozzles are known. Such apparatus is described in U.S. Pat. No. 3,084,661, for example. In this apparatus several foam application nozzles are arranged over the width of the web side by side. The apparatus is used for impregnating a fiber material with a treatment medium contained in a foam, which also may be a dyeing liquid.

Resists which can be applied in foam form, agents which influence the feel or the structure of the web of material, and similar agents may also be considered as the treatment medium for the present invention, in addition to dyeing liquids. The web may be a textile web, but also a nonwoven fabric, a paper web, a plastic web or the like.

It is an object of the present invention to carry out, with apparatus of the basic type described above, a regular pattern application as well as to achieve a uniform application, for instance, plain coloring. In both cases the foam is applied from a multiplicity of nozzles, be it different foams, or foam which is the same everywhere. Frequently, the nozzles will not have separate foam feeding devices, but will be fed from a common foam source.

For liquid pattern making media, such devices which work with nozzles that are supplied in groups, are known, for instance, from British Pat. No. 1,363,724 and U.S. Pat. No. 2,218,811. The known devices comprise one liquid distributor for each individual group, in the form of a tubular canal or a tube section, in which one liquid inlet for feeding the liquid in and several liquid outlets for distributing the liquid to the individual nozzles of the group are provided. Because of the physical pecularity of liquids, the liquid is distributed to the individual nozzles in a sufficiently uniform manner.

This, however, does not apply if foam is to be distributed to different nozzles by means of devices of the kind that are described in British Pat. No. 1,363,724 and U.S. Pat. No. 2,218,811. For, the foam has an entirely different physical behavior, and in particular, a substantially greater mobility than liquid, and pressure cannot be exerted on it to the same degree. It was found that, when distributors of the known type were used, the foam makes a path for itself somewhere and preferably issues from the nozzle located in this path, while the other nozzles are supplied with less foam or none at all. The required uniformity of the foam application from all nozzles can therefore not be achieved in this manner.

It is an object of the present invention to develop apparatus of the type described above, in such a manner that a foam can be distributed uniformly to several application nozzles.

SUMMARY OF THE INVENTION

This problem is solved by providing a foam distributor comprising a chamber with a plurality of foam outlets and a distribution rotor in communication with a foam feed line. The rotor rotates and directs the foam from at least one aperture from inside, toward the foam outlets which are connected to the nozzles.

By means of the revolving distributor rotor the foam in the foam distributor is directed again and again into other directions and the formation of stagnant foam zones and preferred foam canals is suppressed. Under influence of the rotation of the distribution rotor, the foam is again and again directed directly toward one of the foam outlets. Tests have shown that in this manner a completely uniform supply of the different foam outlets with foam can be achieved. The spacing between the opening of the foam distributor and the foam outlets is important if pulsation of the foam at the foam outlets is to be mitigrated or suppressed. If the foam were given off into the foam outlets from an opening passing immediately in front of the foam outlets, such pulsation would take place.

Preferably the distribution rotor has rotational symmetry and the outlets equal circumferential spacing. This embodiment of the foam distributor is most effective as to uniformity due to its roational symmetry and the same direction of the foam outlets and of the foam jet emerging from the distributor rotor.

An arrangement in which the width of the chamber of the distributor is tapered radially outwardly is recommended because thereby a certain amount of compression of the foam flowing toward the outside takes place, which provides homogenization of the foam.

Various alternative embodiments of the foam outlets in the chamber are possible. An arrangement in which the bottom of the chamber is conical and the foam outlets in the chamber wall, near the circumference of the chamber, are directed axially toward the side facing away from the apex of the bottom of the chamber has the advantage that the foam moves toward the foam outlets by itself and, for instance, if the foam supply is terminated, leaves the same completely if the foam distributor with its axis of rotation vertical, is arranged so that the bottom of the chamber drops off radially outward.

The distributor rotor can be designed such that the outlets extend axially from it but it includes a radial opening into each axial outlet Feeding foam in on the side opposite the outlets contributes in that the automatic foam flow toward the foam outlets and the foam discharge are aided if the foam distributor designed in this manner is arranged so that the foam feed line opens into it from the top.

In certain cases it may be advisable to provide, additional vanes which move the foam in the chamber and promote its emergence from the foam outlets.

The present invention is realized even if only one foam distributor is provided. In general, i.e., if a mixture of different foams is not already supplied to this foam distributor, only one kind of foam can be applied. To obtain a pattern, several foam distributors will in general have to be provided for the different foams.

Also shown is patterning apparatus including at least one nozzle beam supporting the nozzles, a fixed support arrangement, with connecting lines extending between the foam distributor and the nozzles fastened to the fixed support arrangement. The connecting lines are flexible tubes leading from the support arrangement to the nozzle beam. The nozzle beam is arranged transversely above the web and is movable transversely to the web and/or about its longitudinal axis.

The support arrangement can also be designed as a beam which is arranged transversely above the web and supports the connecting lines to the nozzles at a point between the foam distributor and the nozzle beam. The hoses can be supported transversely to the web in the same order in which the nozzles are also mounted to the nozzle beam. This prevents the connecting tubes from randomly coming into contact with each other during the movement of the nozzle beam, which could lead to undefined forces on the connecting lines and to their wear. While these connecting lines will, in practice, frequently be realized as continuous tubes leading from the foam distributor to the nozzles, it is also within the scope of the present invention to use stationary lines from the foam distributor to the support arrangement. The mobility, after all, must reside in the last section so that the movements of the nozzle beam can be followed.

Nozzles which dispense different colored foams can be mounted on a nozzle beam, and on the other hand, all nozzles of a nozzle beam can dispense the same colored foam, so that the nozzle beams deposit the different colors or layers of the same color on top of each other.

It is advantageous to drive the distributor rotors of the foam distributors jointly.

The nozzle beam with the movable connecting hoses can, by itself be of the same type as used in the liquid applicator as per U.S. Pat. No. 2,218,811, for example.

The apparatus can be modified further by adding an inclined run-off surface and controllable interruptors for the flow of the foam can be arranged in the connecting lines. Taken by themselves, these features, as applied to a liquid applicator are described in U.S. Pat. No. 1,363,129.

DETAILED DESCRIPTION

Figure 1:
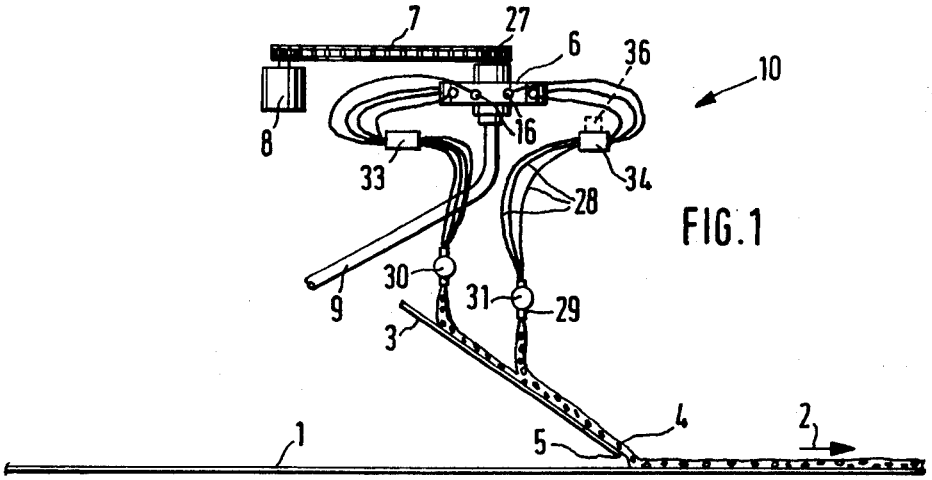
FIG. 1 is a side view of apparatus according to the present invention.

The apparatus 10 in FIG. 1 is used for applying a pattern to a web 1 of a textile material or a similar material in web form which advances continuously in the direction of the arrow 2. Transversely above the web 1, a run-off surface 3 is provided which extends across its entire width and is inclined in a vertical longitudinal plane. A foam layer 4 is applied to surface 3 and from its lower edge 5, which is disposed closely above the web 1, the foam layer 4 slides down due to the inclination of the run-off surface and is transferred to the web 1 without major changes.

At a distance above the run-off surface 3, in the illustrated embodiment, three foam distributors 6 which are arranged side by side at the same height and which are driven jointly, via a chain 7 or a similar flexible driving unit, by a motor 8 are provided. In FIG. 1, only the foam distributor 6 at the front is visible. A foam feeding line 9 which is connected to a foam generating device, not shown, is connected to each foam distributor.

Figures 3, 4:
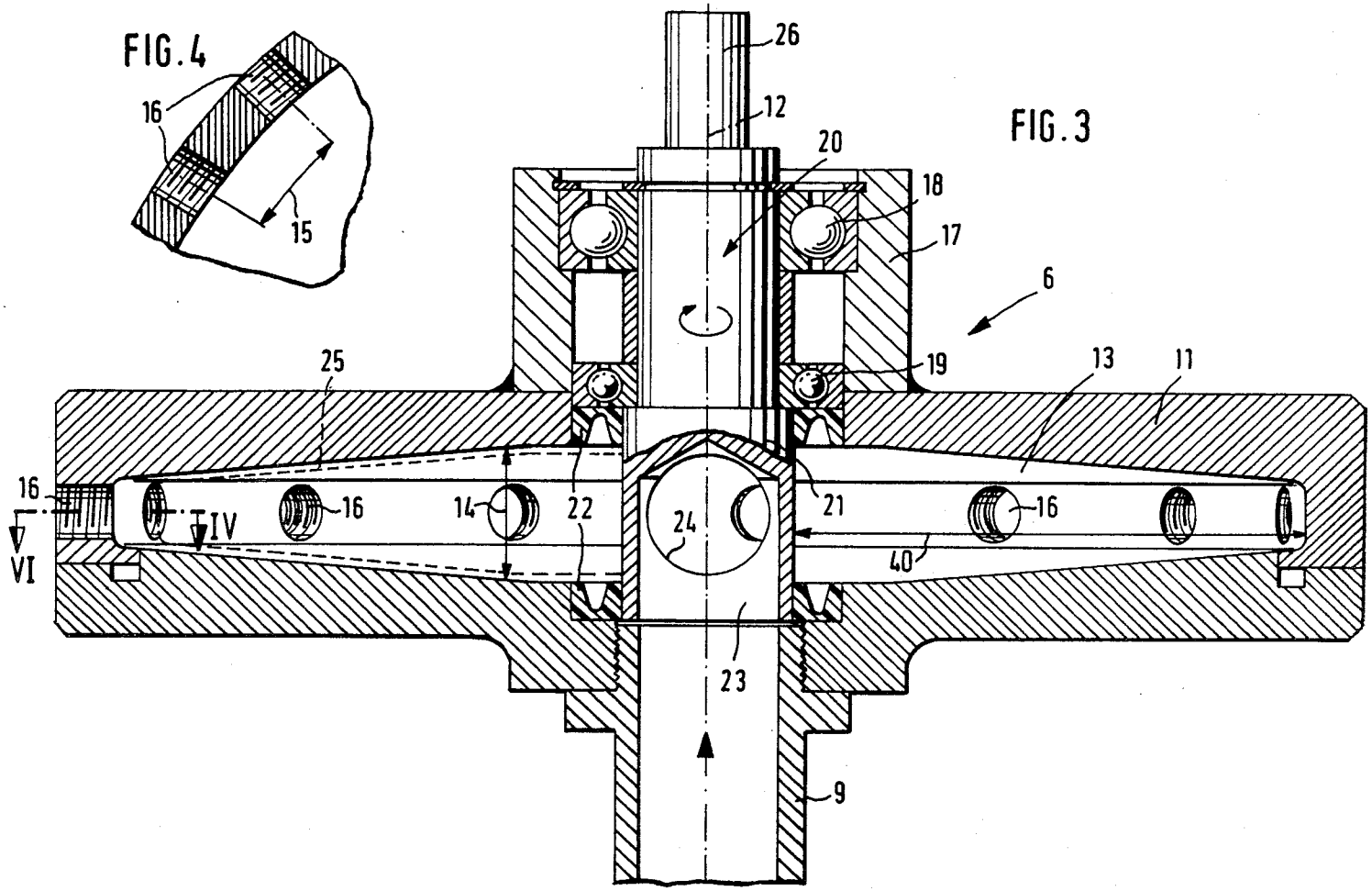
FIG. 3 is a cross section through a foam distributor, taken through the axis.
FIG. 4 is a partial cross section according to the line IV—IV in FIG. 3.

As may be seen from FIG. 3, each foam distributor has a flat cylindrical housing 11 in which an approximately disc-shaped chamber 13 is formed which is rotationally symmetrical with respect to the cylinder axis 12. The axial height 14 of the chamber 13 decreases radially outward so as to compensate for the increase in volume which the flow path which is situated over a given angle range normally has toward the outside. The foam quantity delivered over such an angular range would otherwise be subjected during its radial path, to a pressure reduction, which would be detrimental to the quality of the foam. Rather, a cross section reduction should take place so that the foam is compressed somewhat and is homogenized in this manner.

Fifteen radial foam outlets 16 are distributed over the circumference of the chamber 13 at uniform angular spacings.

From below, according to FIG. 3, the foam feed line 9 opens into the chamber 13 along the axis of the chamber. Distribution rotor 20 is rotatably supported in housing 11 by means of anti-friction bearings 18 and 19 which are disposed in an extension 17 opposite feed line 9. The distribution rotor 20 has a cylindrical part 21 which extends through the chamber 13 in the axial direction and is sealed on the two opposite sides against the axial passage of foam by seals 22. In the cylindrical part 21, the distribution rotor 20 has an axial hole 23 which is open toward the feed line 9 which does not go through and has, at the height of the chamber 13, a radial opening 24 through which the foam can pass from the feedline 9 into the interior of the chamber 13. Between the opening 24 and the foam outlets 16 there is a distance 40 which corresponds approximately to the radius of the chamber 13 and is, in practice, on the order of 3 to 12 cm. Through this distance, pulsation of the foam in the foam outlets 16 and the adjoining connecting lines 28 is dampened or suppressed. Several openings 24 may also be provided. In addition, radial vanes 25 may, in certain cases, be provided at the distribution rotor 20, of which one is indicated in FIG. 3 by dashed lines. The vanes 25 cover the cross section of the chamber 13 and additionally prevent the formation of dead foam zones.

The rotary drive of the distribution rotor 20 is provided by sprocket 27 (FIG. 1) which is mounted on the journal 26 and acted upon by the chain 7 to provide continuous rotation.

The foam outlets 16 of the foam rotors 6 are connected via connecting lines 28 which are realized as flexible tubing, to nozzles 29 which are arranged above the run-off surface and from which the foam emerges onto the run-off surface 3. In the illustrated embodiment each foam outlet 16 is connected to exactly one nozzle 29, which, however, is not mandatory. Two or more foam outlets 16 could also lead from different foam distributors 6 to a nozzle 29.

The nozzles 29 are provided side by side on nozzle beams which are arranged transversely above the run-off surface 3 and of which two beams 30 and 31 are present in the illustrated embodiment. The nozzle beams 30 and 31 can be moved back and forth transversely to the web and can optionally be swung back and forth about their longitudinal axis, as indicated by the arrows 32 and 35 in FIG. 2.

The number of nozzles 29 and thereby, also the number of nozzle beams, depends on the desired pattern. In a web 1 which is 2 m. wide, for instance, about 15 to 30 nozzles may be provided per nozzle beam side by side.

Since the nozzles 29 provided at one nozzle beam usually get their foam from different foam distributors 6 considerable randomness of the connecting lines results. To keep this randomness within limits, fixed support beams 33 and 34 for the connecting lines 28 arranged transversely above the web are provided. Beams 33 and 34 intercept the connecting lines at a point located between the foam distributors 6 and the nozzles 29. With each nozzle beam a support beam 33 or 34 is associated, and the connections to the support beam 33 or 34 are arranged so that they correspond to the arrangement of the corresponding nozzles 29 on its associated nozzle beam 30 or 31. In the last section between the support beams 33 and 34 and the nozzle beams 30 and 31, the connecting lines 28 therefore are parallel with each other so that they do not touch each other in the direction of the arrows 32, 33 when the nozzle beam moves and thereby suffer no damage.

Figure 2:
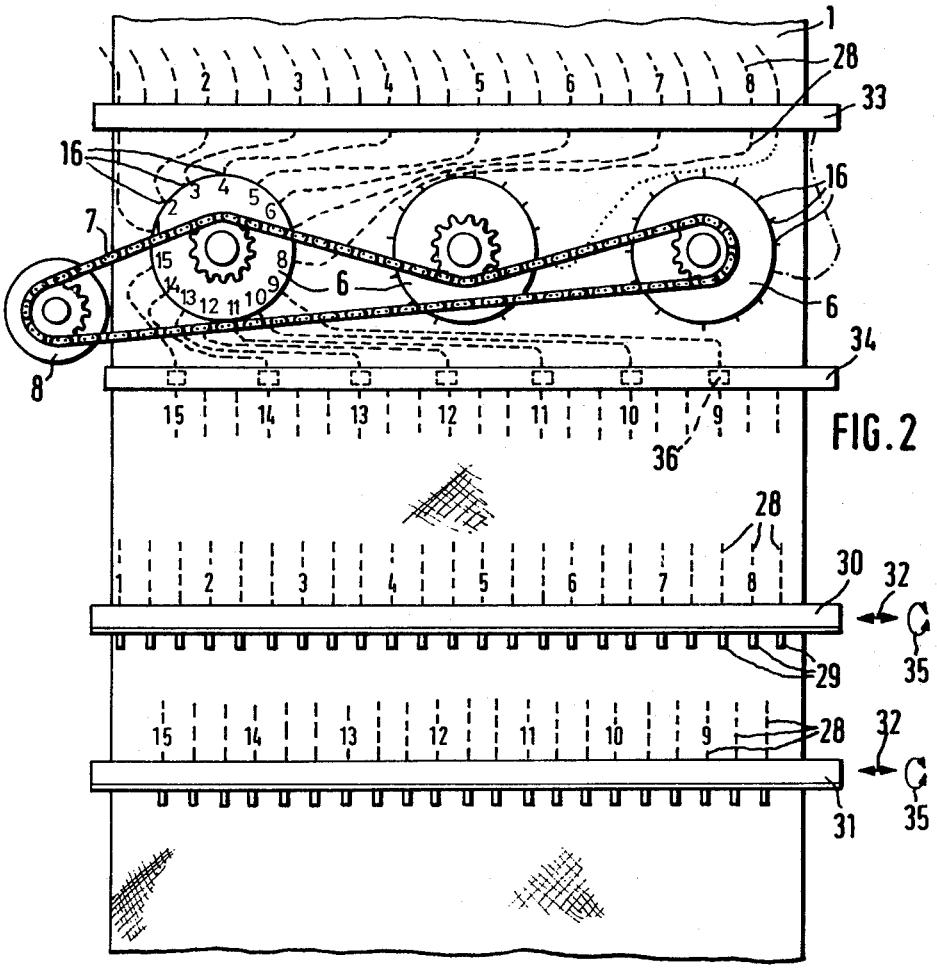
FIG. 2 is a view of the device according to FIG. 1 from above, the individual elements of the apparatus being shown pulled apart.

In order not to confuse the picture, only the connecting lines of the left-hand foam distributor 6 are indicated in FIG. 2. The foam outlets provided with the small numbers 1 to 8 are connected to connecting lines 28, which first go to the support beam 33 and then to the nozzle beam 30. The line ends starting from the support beam 33 and the line ends attached to the nozzle beam 30 of one and the same connecting line 28 each carry the same numbers. The foam outlets with the small numbers 9 to 15, on the other hand, are connected to connecting lines 28 which are run first to the support beam 34 and then to the nozzle beam 31. Only one of each of the connecting lines 28 of the two right-hand foam distributors is indicated dotted or dash-dotted, respectively. They lead to the unnumbered connections at the support beams 33 and 34 and the nozzle beams 30 and 31, respectively.

When the device 10 is in operation, foam zones which extend parallel to each other in the individual nozzle beam, are deposited by the nozzles 29 on the run-off surface 3. The second nozzle beam will generally not move in rhythm with the other nozzle beams, so that the foam strips of the two nozzle beams intersect and interact in forming patterns.

The obtainable pattern can be varied further by arranging interruptors 36 in the connecting lines 28 which may be designed, for instance, as magnetic valves or squeezing devices (pinchcocks) for the hoses forming the connecting lines 28. In FIGS. 1 and 2, such interruptors 36 are indicated by broken lines at the support beam 34 for the connecting lines 9 to 15 of the foam distributor 6 to the left in FIG. 2. It is understood, however, that such interrupters 36 can also be provided for the further connecting lines. The interrupters 36 may also be provided for the other connecting lines. The interrupters 36 can be controlled according to a predetermined scheme or a random distribution.

Figure 5A:
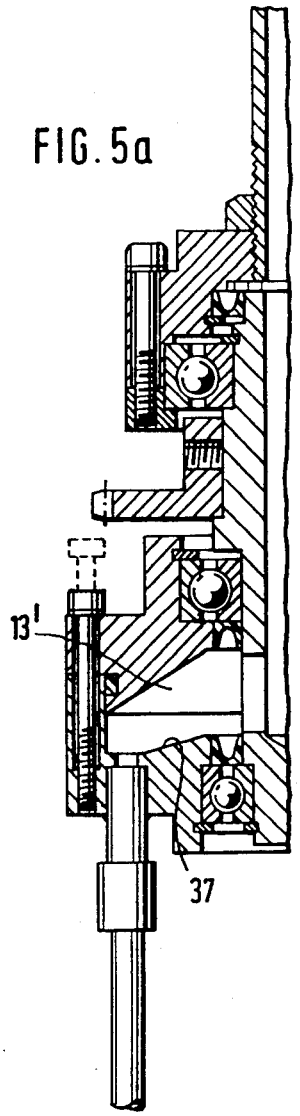
FIG. 5 is a cross section taken through the axis through a further embodiment of foam distributor.
Figure 5B:
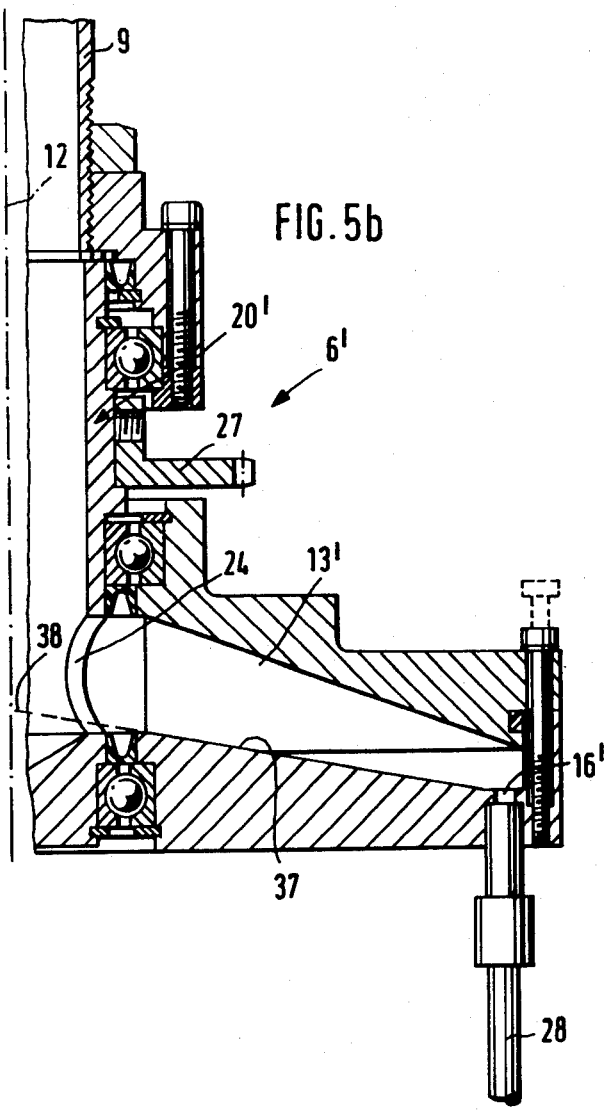

In FIG. 5, another embodiment 6' of the foam distributor is shown, in which parts corresponding to FIG. 3 are designated with the same reference numerals. The foam feed line 9 leads from above into the foam rotor 20' which has the radial opening 24 at the lower end. The chamber 13' has a bottom 37 which is concial and drops, starting from its apex 38 on the axis of rotation 12 of the foam rotor 20' radially outward to the side away from the foam feed line 9. The foam outlets 16' are arranged axially near the circumference of the chamber. The foam entering from above in the position of the foam distributor 6' shown in FIG. 5 thereby runs by itself over the bottom 37 outward toward the foam outlets 16'. The embodiment shown in the left hand of FIG. 5 likewise has the conically dropping bottom 37, and otherwise differs only by a smaller radius of the chamber 13' from the embodiment example of the right-hand side.

With the apparatus shown in FIGS. 1 and 2 it is possible to obtain a pattern with different foams in the individual foam distributors 6 and 6', where the uniformity of the pattern components benefits by the uniformity achieved at the individual foam outlets due to the rotation of the foam rotor 20 or 20'. It is equallly possible to apply the same foam from all foam distributors 6, uniform application over the area being assured.

What is claimed is:

1. In an apparatus for applying foam onto continuously advancing webs of material from several nozzles, the improvement comprising at least one foam distributor, said distributor including:

(a) a stationary housing forming a chamber;

(b) a plurality of spaced foam outlets at the periphery of said chamber, individual ones of said foam outlets coupled to said nozzles;

(c) a feed line for foam;

(d) a rotor, supported for rotation in said chamber, having an inlet in communication with said feed line, and at least one radial outlet aperture opening into said chamber to permit foam from said feed line to be directed into said chamber; and (e) means for rotating said rotor, whereby foam will be distributed in a direction toward different ones of said foam outlets as said rotor is rotated.

2. Apparatus according to claim 1, wherein said aperture is spaced from the foam outlets.

3. Apparatus according to claim 2, wherein said chamber is rotationally symmetric with respect to the axis of rotation of said distribution rotor and said foam outlets are uniformly spaced along the circumference of the chamber.

4. Apparatus according to claim 3, wherein the height of the chamber is tapered radially outward.

5. Apparatus according to claim 3 or 4, wherein said foam outlets are directed radially.

6. Apparatus according to claim 3 or 4, wherein the bottom of the chamber is conical and said foam outlets at the circumference of the chamber are directed axially toward the side facing away from the apex of the bottom of the chamber.

7. Apparatus according to claim 1, wherein said foam feed line leads axially into the distribution rotor and said distribution rotor has an internal passage with at least one radial aperture for the foam.

8. Apparatus according to claim 7, wherein said foam feed line leads into the distribution rotor from the side facing away from the foam outlets.

9. Apparatus according to claim 1, wherein at least one vane extends into over the cross section of the chamber and at least in part is connected to the distribution rotor.

10. Apparatus according to claim 1 comprising several foam distributors for different foams.

11. Apparatus according to claim 10, wherein the distribution rotors of said foam distributors are driven jointly.

12. Apparatus according to claim 1 and further including: at least one nozzle beam supporting the nozzles transversely spaced across the web; a fixed support arrangement connecting lines between the foam distributor and the nozzles fastened to said fixed support arrangement, and said connecting lines comprising flexible tubes leading from said support arrangement to said nozzle beam, said nozzle beam arranged transversely above the web and movable transversely to the web and/or about its longitudinal axis.

13. Apparatus according to claim 12, wherein a plurality of foam distributors are provided and the nozzles of a nozzle beam are connected to different foam distributors.

14. Apparatus according to claim 12, wherein the nozzles of a nozzle beam all are connected to the same foam distributor.

15. Apparatus according to claim 1 and further including a run-off surface which extends transversely across the web and is inclined downward at an angle in a longitudinal plane perpendicular to the web disposed below said nozzles.

* * * * *